US005272899A

United States Patent [19]

Mediate

[11] Patent Number: 5,272,899

[45] Date of Patent: Dec. 28, 1993

[54] METHOD AND APPARATUS FOR HOT ROLL FORMING INSIDE U-SHAPED CHANNEL SECTION

[75] Inventor: Joseph Mediate, Girad, Ohio

[73] Assignee: McDonald Steel Corp., McDonald, Ohio

[21] Appl. No.: 945,883

[22] Filed: Sep. 17, 1992

[51] Int. Cl.[5] ..... B21B 1/12

[52] U.S. Cl. ..... 72/177; 72/181; 72/234

[58] Field of Search ..... 72/177, 181, 180, 176, 72/234, 226

[56] References Cited

U.S. PATENT DOCUMENTS

| | | | |
|---|---|---|---|
| 1,086,789 | 2/1914 | Slick | 72/177 |
| 1,574,397 | 2/1926 | Kirsch | 72/181 |
| 1,624,340 | 4/1927 | Heinle | 72/181 |
| 1,856,269 | 5/1932 | Schulz et al. . | |
| 2,505,241 | 4/1950 | Gray et al. . | |
| 3,485,076 | 12/1969 | Colburn . | |
| 4,267,954 | 5/1981 | Smith | 72/181 |
| 4,334,419 | 6/1982 | Kishikawa | 72/177 |
| 4,821,550 | 4/1989 | De Barea, Sr. . | |

FOREIGN PATENT DOCUMENTS

| | | | |
|---|---|---|---|
| 650797 | 10/1937 | Fed. Rep. of Germany | 72/181 |
| 256003 | 12/1927 | Italy | 72/181 |
| 91927 | 7/1981 | Japan | 72/177 |
| 19763 | 5/1984 | Japan | 72/177 |
| 161427 | 7/1987 | Japan | 72/177 |
| 829256 | 5/1981 | U.S.S.R. | 72/181 |
| 33 | of 1900 | United Kingdom | 72/176 |
| 82/01484 | 5/1982 | World Int. Prop. O. | 72/226 |

*Primary Examiner*—Daniel C. Crane
*Attorney, Agent, or Firm*—Harpman & Harpman

[57] ABSTRACT

A method of hot roll forming compound metal channel sections from a bar blank using multiple shaped rollers and progressive roller sets. An inside U-shaped channel section is hot roll formed by rolling opposing channel section towards one another while maintaining support and spacing therebetween.

4 Claims, 3 Drawing Sheets

METHOD AND APPARATUS FOR HOT ROLL FORMING INSIDE U-SHAPED CHANNEL SECTION

BACKGROUND OF THE INVENTION

1. Technical Field

This invention relates to hot roll forming elongated channel configurations by passing bar stock through multiple shaped roller pairs that progressively impart the desired shape to the material as it passes therebetween.

2. Description of Prior Art

Prior art devices of this type have relied on a variety of different roller shapes and roller positions to form the material into different sectional configurations, see for example U.S. Pat. Nos. 1,856,269, 2,505,241, 3,485,076, 4,821,550.

In U.S. Pat. No. 1,856,269 a method and means for rolling channel sections is disclosed wherein vertical rollers progressively roll shape the blank into U-shaped channel having a cross-sectionally thin base with oppositely disposed upstanding flanges.

In U.S. Pat. No. 2,505,241 a method of making Oge gutter is shown wherein a channel is formed from strip material. The relatively thin strip material is formed by multiple roller pairs spaced in oppositely disposed relation to one another in both vertical and horizontal actual alignment. The Oge gutter is used on houses and the like.

U.S. Pat. No. 3,485,076 discloses a roll form apparatus having mating roller disks with rigid and resilient portions. This arrangement allows for portions of the material being processed to be formed between the rigid portions and confined between the resilient portions allowing the parts to vary. This combination imparts dimensional integrity to the shape.

U.S. Pat. No. 4,821,550 discloses an adjustable roll forming machine formed of lightweight material in a unitary construction. Multiple rolls are driven by a single continuous chain drive in a sequential manner and groups of rollers can be removed in a single step for servicing an adjustment.

SUMMARY OF THE INVENTION

A method and apparatus to hot roll form an contoured channel section from bar stock. Multiple pairs of vertically opposing shaped rollers each impart a progressive shape to the stock to form a U-shaped channel. A final roll pair forms an inside channel configuration therefrom.

DESCRIPTION OF THE PREFERRED EMBODIMENT

Figure 1:
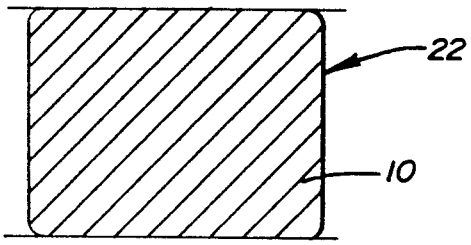
FIG. 1 illustrates a cross-sectional view of a bar blank used in rolling the section.
Figure 2:
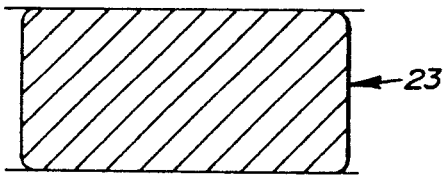
FIG. 2 shows a cross-section of the bar blank in its first pass through the mill rolls.

Referring to FIGS. 1 and 2 of the drawings, a bar blank 10 having been heated to the required temperature can be seen in cross-section having been partially reduced to a moderately rectangular shape from a typically cross-sectionally square configuration common within the art.

Figure 9:
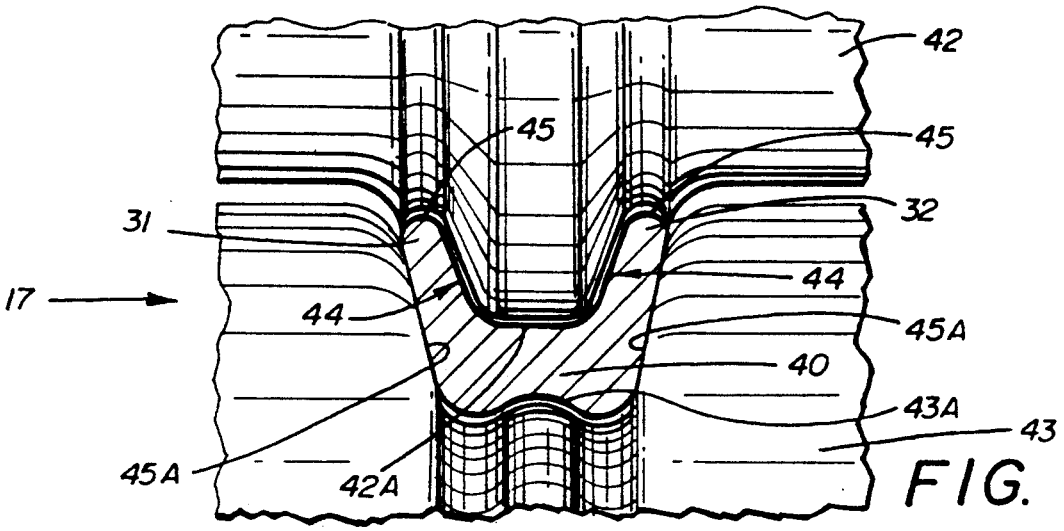
FIG. 9 shows a cross-section of the bar blank and a portion of a seventh set of shaping rollers.
Figure 10:
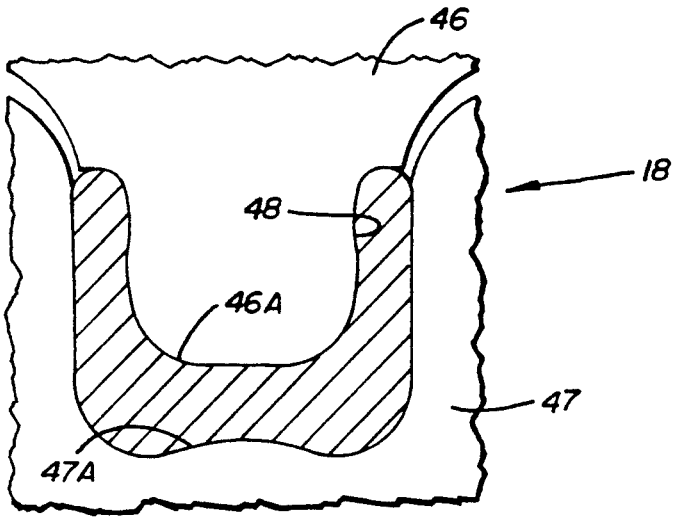
FIG. 10 is an enlarged cross-section of the bar blank and a portion of a eighth set of shaping rollers.
Figure 11:
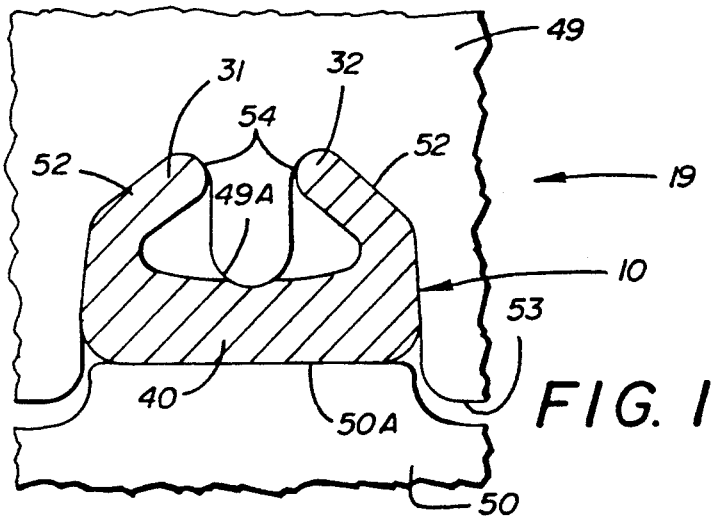
FIG. 11 is an enlarged cross-section defining an contoured.
Figure 12:
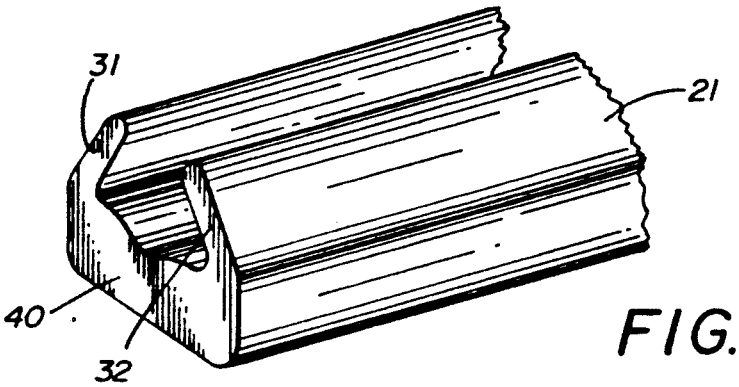
FIG. 12 is a perspective view of the finished contoured section.

A sequence of roller stations 11–19 illustrated in FIGS. 3–11 of the drawings define the overall blank reduction and shaping process to form an inside U-shaped channel configuration 21 as best seen in FIGS. 11 and 12 of the drawings.

Each of the representative roller stations have two vertically aligned shaping rollers generally referred to as A and B for illustration purposes. The shaping rollers are positioned in a standard power rolling mill configuration (not shown).

FIGS. 1 and 2 represent the initial process formation of a cross-sectionally rectangular shapes 22 and 23 by non-descriptive reduction rollers (not shown) well known within the industry and the art.

Figure 4:
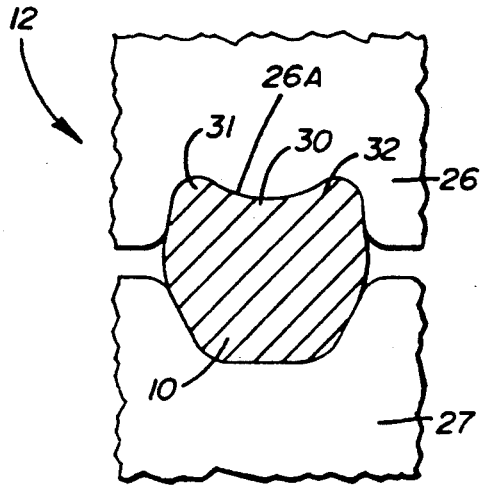
FIG. 4 shows a cross-section of the bar blank in a portion of a second set of shaping rollers.
Figure 5:
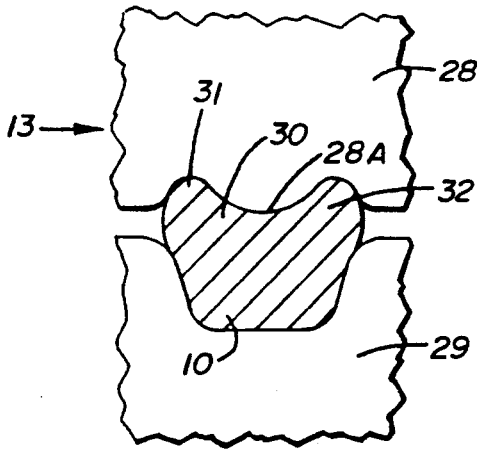
FIG. 5 shows a cross-section of the bar blank and a portion of a third set of shaping rollers.
Figure 3:
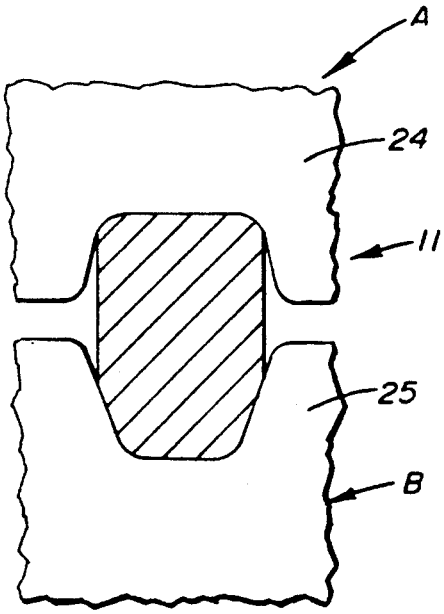
FIG. 3 shows a cross-section of the bar blank and a portion of a first set of shaping rollers.

Referring now to FIGS. 3,4, and 5 of the drawings, appropriate roller stations 11–13 can be seen having in station 11 a first pair of shaping rollers 24 and 25 imparting in oppositely tapered areas 26 and 27 on the bar blank 10. Station 12 and 13 have representative shaping rollers 26, 27 and 28 and 29. The rollers 26 and 28 have contoured cylindrical surfaces 26A and 28A adapted to engage the bar blank 10 imparting a recess at 30 in the bar blank to define the beginnings of respective flanges 31 and 32 thereto.

Figure 6:
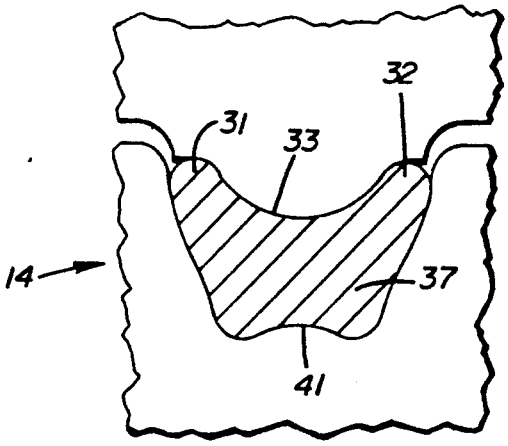
FIG. 6 shows a cross-section of the bar blank and a portion of a fourth set of shaping rollers.
Figure 8:
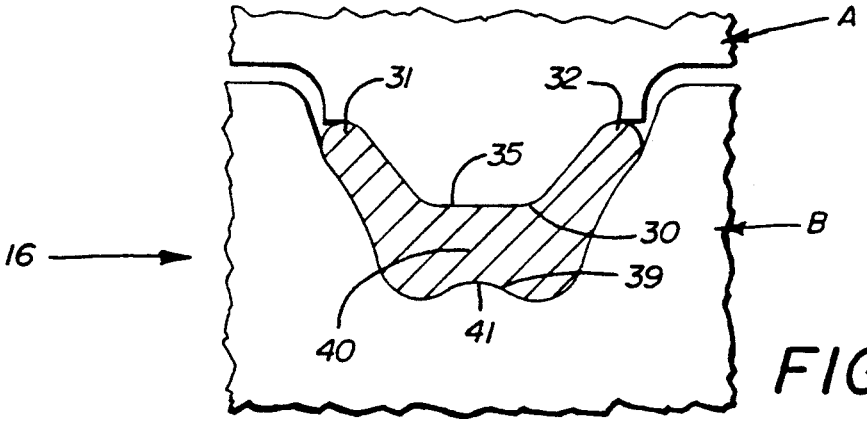
FIG. 8 shows a cross-section of the bar blank and a portion of a sixth set of shaping rollers.
Figure 7:
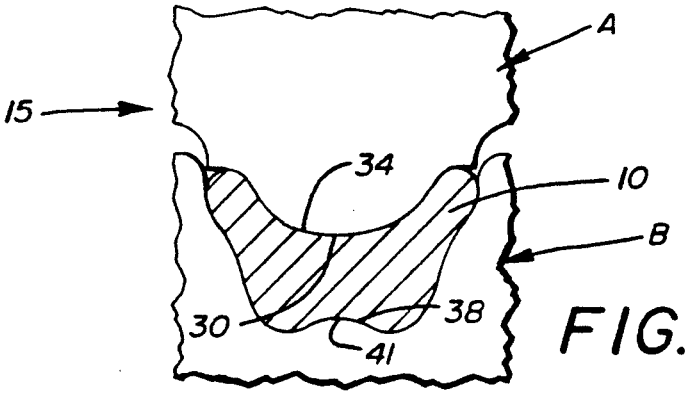
FIG. 7 shows a cross-section of the bar blank and a portion of a fifth set of shaping rollers.

Referring now to FIGS. 6–8 of the drawings and respective stations 14–16, contoured cylindrical upper roller surfaces 33,34, and 35 are of increasing central transverse dimension imparting a progressively deeper recess at 30 within the bar blank with the addition of corresponding lower cylindrical surfaces 37,38, and 39 imparting a secondary recess at 41 in the bar blank 10 defining a web portion 40.

The spaced flanges 31 and 32 have now taken on increased longitudinal dimension as best seen in FIG. 8 of the drawings.

Referring now to FIG. 9 of the drawings, a roll station 17 can be seen having an upper roller 42 and a lower roller 43. The upper roller 42 has a web engagement cylindrical portion 42A of increased rolling surface. Beginning at each edge of the cylindrical portion the diameter of the roll gradually diminishes defining tapered surfaces 44. The roll dimension then increases to define respective flared surfaces 45 forming concave grooves adapted to engage the respective free ends of the hereinbefore disclosed flanges 31 and 32 of the processed bar blank 10. The lower roller 43 has a continued contour cylindrical surface 43A of generally reduced dimension adapted to engage the web portion 40 between the flanges 31 and 32. Beginning at each edge of the cylindrical surface 43A the dimension of the roll increases defining a tapered surface 45A engaging the flanges 31 and 32.

As best seen in FIG. 10 of the drawings the roll station 18 is illustrated wherein the upper and lower rolls 46 and 47 respectively complete the cross-sectional formation of the U-shaped section to the bar blank 10.

The upper roll 46 has a web engagement cylindrical surface portion 46A of increased roller dimension with vertically extending offset surface area 48 in oppositely disposed relation to one another. The lower roll 47 has a generally U-shaped recessed surface area at 47A defining a cross-sectionally U-shaped section in which the flanges 31 and 32 are of equal cross-sectional dimension that is less than the cross-sectional dimension of said web portion 40.

It is critical to emphasize the dimensional characteristics of the flanges in relation to the web portion which is required so that adequate material is available for the final formation of the inside U-channel section.

A final finish roller configuration is illustrated in illustration 19 as best can be seen in FIG. 11 of the drawings having an upper roller 49 and a lower roller 50. The upper roller 49 has a reduced roller surface 49A engaging the web portion 40 of the U-shaped section of the bar blank 10.

Beginning at each edge of said roller surface 49A the diameter of the upper roller increases defining gradual tapered surfaces 52 terminating inwardly of said maximum roller dimension at 53. The area of transition between said roller surface 51 and increased roller dimension at 53 is characterized by perspective transitional grooves 54. The lower roller. 50 has a large surface area 50A in contact with the web portion 40.

In operation, as the cross-sectionally U-shaped section of FIG. 10 is engaged by the respective rollers 49 and 50, the edge flanges 31 and 32 are folded over and inwardly by engagement with the tapered surfaces 52. The respective free ends of the flanges 31 and 32 abut within the transitional grooves 54 while the roller surface 49A engages and holds the channel shape as hereinbefore described. The lower roller 50 flattens the outer web portion 40 opposite said upper roller engagement.

Referring now to FIG. 12 of the drawings, said inside U-shaped channel configuration section 21 can be seen having a slightly contoured inside web portion 40, oppositely disposed upstanding flanges 31 and 32 which are now curved inwardly.

It will thus be seen that a new and novel apparatus and method for roll forming an inside U-shaped channel section has been illustrated and described and it will be apparent to those skilled in the art that various changes and modifications can be made therein without departing from the spirit of the invention.

Therefore I claim:

1. A method for rolling a contoured channel section comprising the steps of a. rolling an elongated blank through multiple rolling stations b. forming in one of said rolling stations an elongated blank of U-shaped cross-section having spaced upstanding flanges with a web portion therebetween on one side thereof, said web portion of said elongated blank being of greater thickness than said upstanding flanges c. forming a contoured channel from said elongated blank in the final rolling station while maintaining said greater thickness web portion by bending said respective upstanding flanges inwardly in spaced relation to one another and said web portion by upper and lower rollers with the upper roller having a reduced roller surface positioned between said upstanding flanges and engaging said web portion, and tapered surfaces of increasing diameter extending from both sides of said reduced roller surface engaging outer surfaces of said upstanding flanges with a transition area between said reduced roller surface and said respective tapered surfaces wedgeably engaging free ends of said respective upstanding flanges so that said free ends of the upstanding flanges are positioned closer to one another than the jointing locations of the upstanding flanges with the web portion.

2. The method of claim 1 wherein said multiple rolling stations each have a pair of shaped opposing rollers.

3. The method of claim 1 wherein said step of forming an elongated blank having spaced upstanding flanges comprises passing said elongated blank through progressive shaped roller pairs in each of said roller stations.

4. An apparatus for rolling a contoured channel section comprises, a rolling mill configuration having multiple rolling stations within, each of said rolling stations having male and female shaped rollers of generally cylindrical configuration being rotatably mounted in spaced opposing relation to one another, each of said roller stations progressively form an elongated blank of U-shaped cross-section having spaced upstanding flanges with a web portion therebetween, said opposed rollers in said stations being spaced so as to produce said web portion with a cross-section of greater thickness than said upstanding flanges, a finish roller station having upper roller and a lower roller, said upper roller having a reduced roller surface positioned between said upstanding flanges and engaging said web portion, tapered surface of increasing diameter extending from both sides of said reduced roller surface, transition area between said reduced roller surface and said respective tapered surface wedgeably engaging free ends of said respective upstanding flanges, said transition area and tapered surfaces being located on said upper roller so that said free ends of the upstanding flanges are positioned closer to one another than the jointing locations of the upstanding flanges with the web portion.

* * * * *